US005754014A

United States Patent [19]

Kim et al.

[11] Patent Number: 5,754,014

[45] Date of Patent: May 19, 1998

[54] ELECTRON GUN FOR A COLOR PICTURE TUBE

[75] Inventors: Kyung-ho Kim, Taeku, Rep. of Korea; Francis Joseph Campbell, Yardley, Pa.

[73] Assignee: Orion Electric Co., Ltd., Kyungsangbuk-Do, Rep. of Korea

[21] Appl. No.: 346,624

[22] Filed: Nov. 30, 1994

[30] Foreign Application Priority Data

Nov. 30, 1993 [KR] Rep. of Korea ..... 1993-26167

[51] Int. Cl.[6] ..... H01J 29/52

[52] U.S. Cl. ..... 315/382.1

[58] Field of Search ..... 315/382.1, 382

[56] References Cited

U.S. PATENT DOCUMENTS

| | | |
|---|---|---|
| 4,825,120 | 4/1989 | Takahashi . |
| 5,347,202 | 9/1994 | Stil . |
| 5,386,178 | 1/1995 | Son et al. . |
| 5,404,071 | 4/1995 | Son . |

FOREIGN PATENT DOCUMENTS

| | | |
|---|---|---|
| A0366245 | 5/1990 | European Pat. Off. . |
| A0440234 | 8/1991 | European Pat. Off. . |
| A4233955 | 11/1993 | Germany . |

OTHER PUBLICATIONS

Shirai & Noguchi, Reduction of Dynamic Focus Voltage in Color CRTs, (Hitachi, Ltd. Japan), 1991 SID International Symposium Digest of Technical Papers, pp. 695–698.

*Primary Examiner*—Theodore M. Blum
*Attorney, Agent, or Firm*—Morgan & Finnegan, LLP

[57] ABSTRACT

The present invention discloses an improved electron gun for a color picture tube.

The present gun having a triple electrode part, a prefocusing lens part for preliminarily focusing and accelerating the electron beam from the triple electrode part, and a main lens part for finally focusing and accelerating the beam from the prefocusing lens part, is characterized in that the prefocusing lens part comprises a plurality of focusing lenses for forminig at last one quadrapole lens, and two different focusing voltages each of which being dynamically changed synchronized with the deflection signal, are selectively applied to each focusing electrode. Thus, a uniform beam section can be obtained all over the screen.

4 Claims, 4 Drawing Sheets

FIG. 4
PRIOR ART
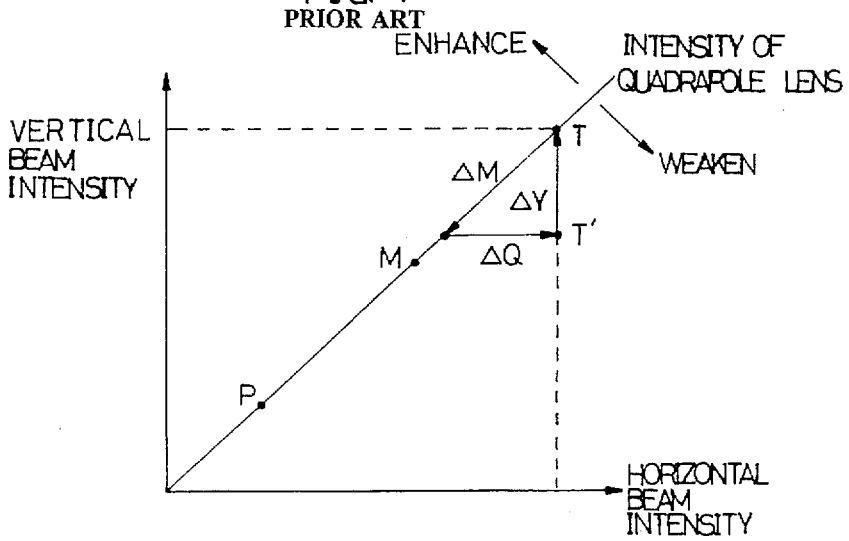
FIG. 5
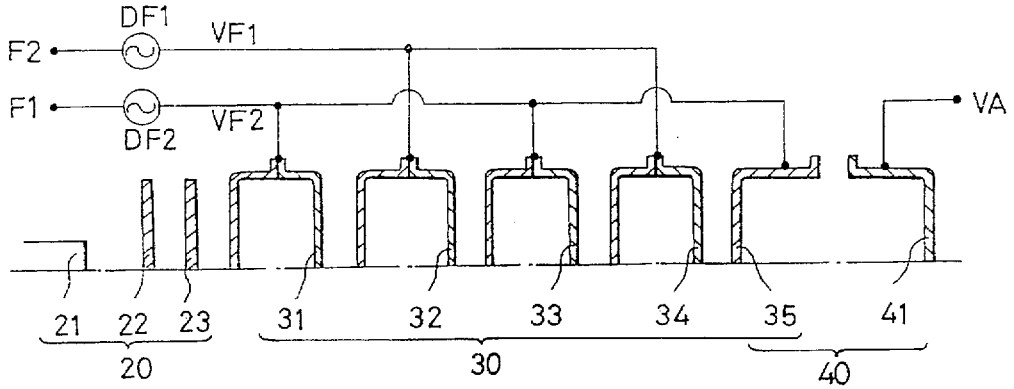
FIG. 6
| F1 | F2 | DF1 | DF2 | VF1 | VF2 | VF2 − VF1 |
|---|---|---|---|---|---|---|
| 6200 | 7000 | 0 | 0 | 6200 | 7000 | 800 |
| 6200 | 7000 | 200 | 400 | 6400 | 7400 | 1000 |
| 6200 | 7000 | 400 | 800 | 6600 | 7800 | 1200 |

ELECTRON GUN FOR A COLOR PICTURE TUBE

FIELD OF THE INVENTION

The present invention relates to an electron gun for a color picture tube, and particularly to a gun improved in a method for applying voltages to component electrodes of the gun.

BACKGROUND OF THE INVENTION

In a conventional picture tube, electron beams emitted from an electron gun, fabricated in the neck of the tube, are selectively landed on a phosphor screen to form an image, after being deflected by a deflection yoke according to their scan positions.

It is, therefore, most important to make the electron beam emitted from the gun be precisely landed at a prescribed position in the screen, to form a better image.

When the beam is deflected to the peripheral part of the screen, the beam is effected by the non-uniform magnetic field of the deflection yoke, resulting in an enlarged and deformed landing spot on the screen, thus revealing poor focusing. This phenomenon severely spoils the resolution of high-definition TV, such as HDTV or WIDE VISION.

To resolve the above problem, dynamic focusing is conventionally adopted, which utilizes a quadrapole lens for deforming the section of electron beams in the direction opposite that of the non-uniform magnetic effect of the deflection yoke and varying the focus voltage of the beam accordingly as the beam scans the central part and peripheral part of the screen.

As a dynamic focusing method, there has been proposed a structure using one dynamic voltage and two focusing voltages, and a structure using two dynamic voltages and two focusing voltages.

Referring to FIG. 1, there is illustrated an example of an electron gun for a color picture tube adopting dynamic focusing.

The gun comprises a cathode 11, a control electrode 12, and a screen electrode 13, each of which constitutes a triple electrode part, and the first to fifth focusing electrodes 14, 15, 16, 17, 18 for forming electrostatic lenses for an auxiliary and main focusing system, and a fmal accelerating electrode 19 adjacent to the high voltage electrode 18 and forming a main lens together.

Prescribed voltages are respectively applied to each of the above electrodes. A static voltage VS is applied to the screen electrode 13 and the second focusing electrode 15, a focusing voltage VF1 to the first and fourth focusing electrodes 14, 17, a dynamic focusing voltage VF2 based on the focusing voltage to the third and fifth electrodes 16, 18 and an anode voltage VA higher than any other voltage to the final accelerating electrode 19.

In FIG. 2, there is shown change of the focusing voltage VF1 and the dynamic focusing voltage VF2 during the scan of the electron beam of the screen. In FIG. 3, the voltage variation in the scanning of one field is illustrated.

If we investigate the lens intensity of the dynamic focusing gun, namely the lens intensity of the horizontal and vertical aberration components of the electron beam with reference to FIGS. 2 and 3, we find that the same voltage is applied to the first, third, fourth and fifth focusing electrode 14, 16, 17, 18 as depicted in FIGS. 2 and 3, when the electron beam emitted from the cathode 11 of the gun scans the central portion of the screen as shown in FIG. 4.

Resultantly, a quadrapole lens is not formed between focusing electrodes, thus the lens intensity T of the gun can be expressed by the sum (T=P+M) of the initial prefocusing lens intensity P, formed between triple electrodes and the focusing electrodes, and the main lens intensity M.

This case does not reveal the difference in the vertical and horizontal aberration components, thus the beam spot landing on the central portion forms a circle without any deformation.

When the dynamic focusing voltage VF2 is applied, the main lens intensity is weakened by $\Delta M$, and the intensity of the quadrapole lens formed between each focusing electrode 14, 15, 16, 17, 18 is changed by $\Delta Q$.

Thus, the resultant overall intensity T' of the dynamic lens becomes $P+\Delta M+\Delta Q$. When the beam is deflected by the non-uniform magnetic field of the deflection yoke, it is vertically over-focused by $\Delta Y$. As a result, the overall dynamic lens intensity T' and the focus intensity $\Delta Y$ by the non-uniform field are combined, to form a circular beam spot on the peripheral portion of the screen.

However, the above described compensation of the sectional deformation of the electron beam due to the non-uniform magnetic field by changing the beam section with adoption of quadrapole lens to the main lens cannot provide satisfactory compensation, as the effect of the quadrapole lens is too weak.

SUMMARY OF THE INVENTION

It is therefore an object of the present invention to provide an electron gun which can form a uniform beam section all over the screen to uplift focusing characteristics and resultantly improve the resolution of the cathode ray tube.

To achieve the above object, an electron gun for a color picture tube having a triple electrode, a prefocusing lens for preliminarily focusing and accelerating the electron beam emitted from the triple electrode and formed by a set of at least one round lens and at least one quadruple lens, and a main lens for finally focusing and accelerating the electron beam passed through the prefocusing lens is disclosed.

The electron gun of the present invention is characterized in that the prefocusing lens comprises a first to fifth focusing electrode arranged successively from the triple electrode, where at least two different dynamically changing focus voltages being applied respectively to the first, third and fifth focusing electrodes in common and to the second and fourth electrodes in common, with the prefocusing lens always having negative astigmatism and the main lens having positive astigmatism.

According to one aspect of the present invention, the prefocusing lens part comprises the first to fifth focusing electrodes arranged successively from the triple electrodes, and two different focusing voltages, each of which is dynamically changing synchronized with the deflection signal, are respectively applied commonly to the first, third and fifth electrodes, and commonly to the second and fourth electrodes.

BRIEF DESCRIPTION OF THE DRAWINGS

These and other objects and advantages of the present invention will be more apparent from the following detailed description, with reference to the accompanying drawings, in which:

FIG. 4 is a graph depicting the lens intensity of a conventional electron gun for a color picture tube;

FIG. 5 is a sectional view of the electron gun according to the present invention, showing voltages applied to each of the electrode;

FIG. 6 is a table showing voltages applied to the electrodes of the gun shown in FIG. 5;

10(B) for the state of the dynamic voltage being applied.

DETAILED DESCRIPTION OF THE INVENTION

Figure 10A:
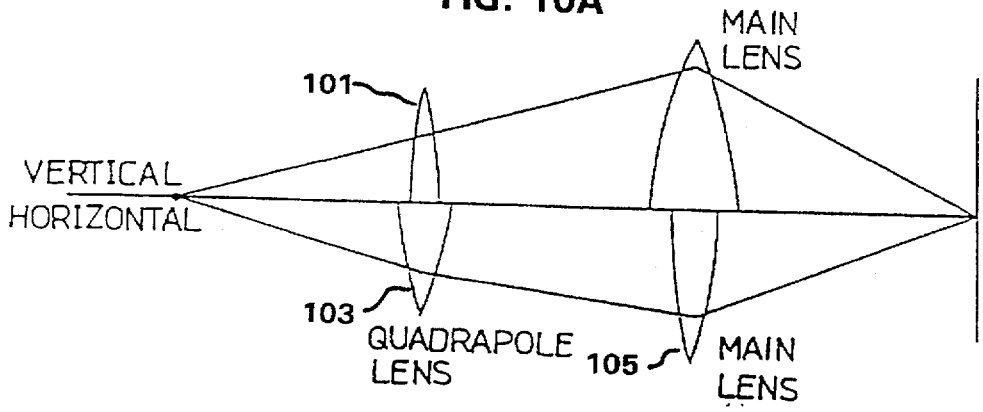
FIGS. 10(A)(B) are schematic drawings respectively showing the prefocusing lens and main lens formed by applying voltages to the electrodes of the gun according to the present invention, and particularly 10(A) for the state of the dynamic voltage not being applied.
Figure 10B:
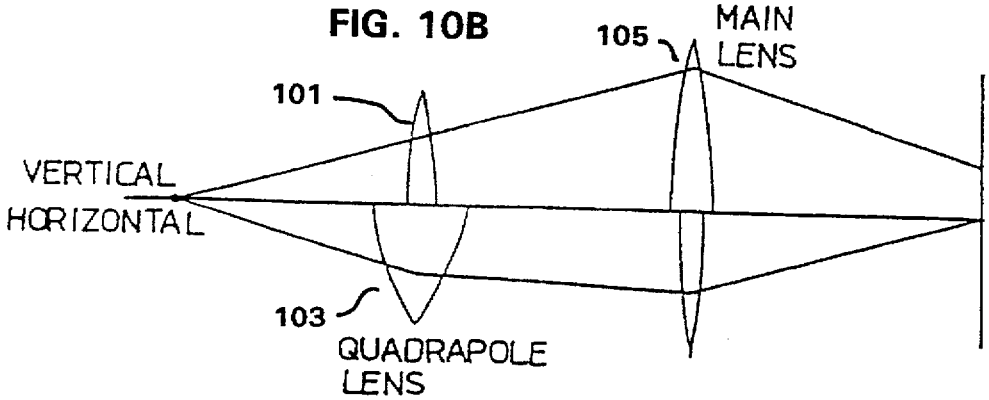

Referring to FIGS. 5, 10A and 10B an electron gun for a color picture tube according to one embodiment of the present invention, includes a triple electrodes part 20 comprising a cathode 21 as a source of electron beam, a control electrode 22 thereof and a screen electrode 23; a prefocusing lens part 30 having the first to fifth focusing electrodes 31, 32, 33, 34, 35 being successively arranged from the screen electrode 23 for forming at least one circular lens (101 in FIGS. 10A and 10B) and one quadrapole lens (103 in FIGS. 10A and 10B) to preliminary focus and accelerate the electron beam emitted from the triple electrode part 20; and a main lens (105 in FIGS. 10A and 10B) part 40 having a fmal accelerating electrode 41 fabricated adjacent to the fifth focusing electrode 35.

Respectively prescribed voltages are applied to each of the electrodes constituting an electron gun, as follows.

Two different focusing voltages F1, F2 and respectively applied commonly to the first, third and fifth focusing electrodes 31, 33, 35, and commonly to the second and fourth electrodes 32, 34. Two dynamic voltages DF1, DF2 synchronized with the deflection signal are respectively added to each of focusing voltages F1, F2. An anode voltage VA of high level is applied to the final accelerating electrode 41. The higher level of the two dynamic voltages DF1, DF2 is preferably twice that of the lower level.

Referring to FIG. 6, there are listed levels, for example, of focusing voltages F1, F2 and dynamic voltages DF1, DF2 applying to electrodes of the gun. As shown in the table, 6200 V and 7000 V are respectively applied as two focusing voltages F1, F2; 400 V and 800 V, or, 200 V and 400 V, are respectively applied as two dynamic voltages DF1, DF2 which are synchronized with the deflection signal. Voltages VF1, VF2 correspond to sums of each of the two focusing voltages F1, F2 and dynamic voltages DF1, DF2, respectively.

Now, operation of the electron gun according to the present invention will be described with reference to FIG. 7 at sequitur.

Figure 1:
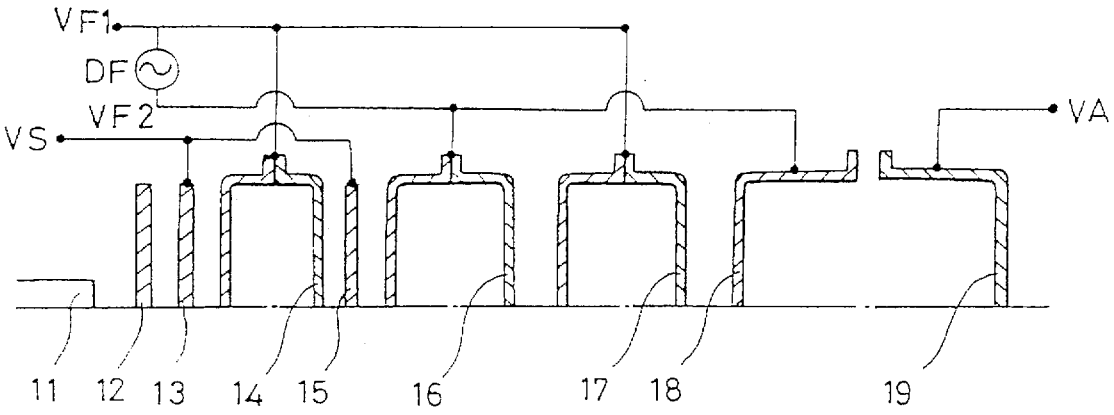
FIG. 1 PRIOR ART
FIG. 1 is a sectional view of a conventional electron gun for a color picture tube, showing voltages applied to each electrode.
Figure 2:
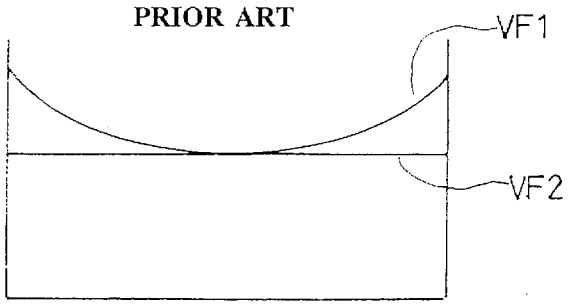
FIG. 2 PRIOR ART
FIG. 2 is a graph illustrating the change of the focusing voltage and the dynamic focusing voltage during the beam scanning the screen.
Figure 3:
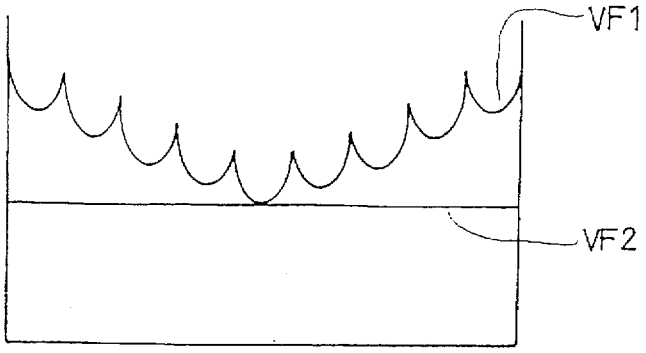
FIG. 3 PRIOR ART
FIG. 3 is a graph showing the change of the focusing voltage during the scanning of one field.
Figure 7:
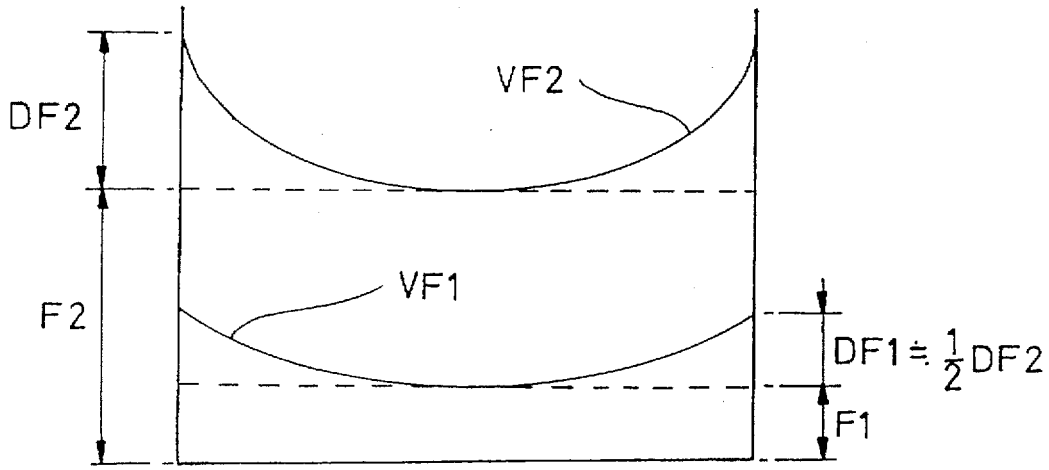
FIG. 7 is a graph depicting focusing voltages and dynamic focusing voltages during scanning of the beam on the screen.
Figure 8:
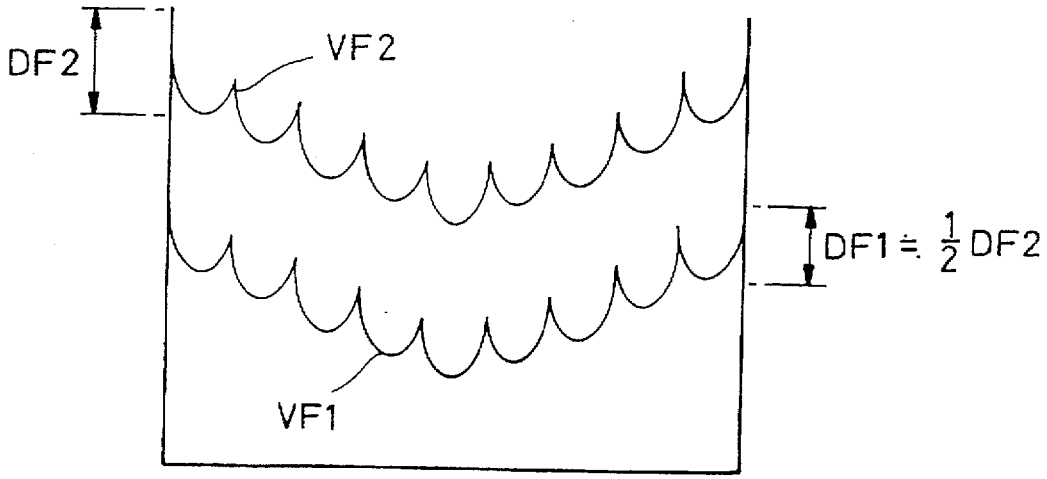
FIG. 8 is a graph showing the change of focusing voltage during beam scanning of one field.

The change of dynamic focusing voltages VF1, VF2 during the scanning of a screen is shown in FIG. 7, and the change of focusing voltages during the scanning of one field is shown in FIG. 8.

Figure 9:
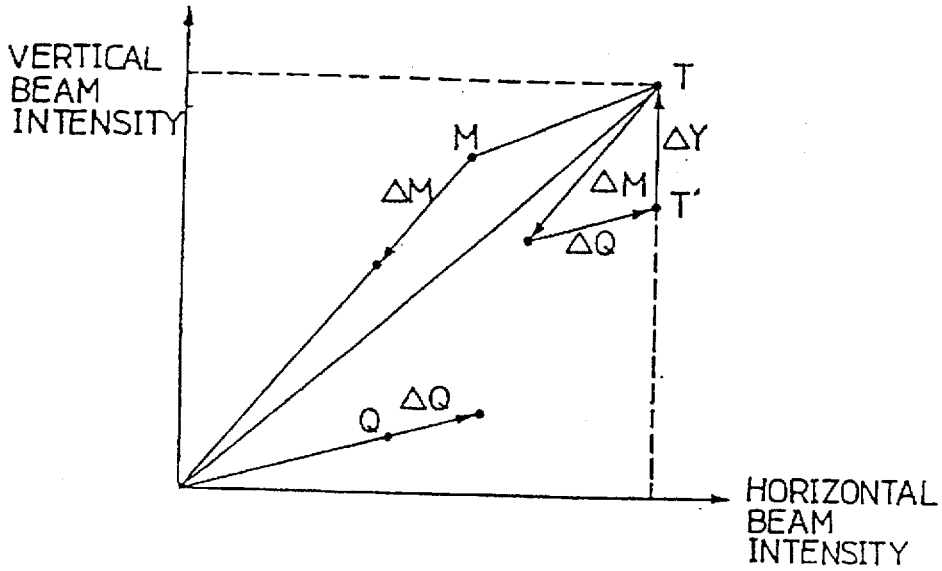
FIG. 9 is a graph illustrating the lens intensity of the electron gun for a color picture tube according to the present invention.

When the above described voltages are applied to the electrodes, electrostatic lenses are formed between each electrode. The lens intensity, namely the intensity of the horizontal aberration components and the vertical aberration components, are as follows. When the electron beam emitted from the cathode 11 of the electron gun scans the central portion of the screen as shown in FIG. 9, the focusing voltage F2 of 7000 V is applied to the first, third, and fifth focusing electrode 31, 33, 35, and the focusing voltage F1 of 6,200 V is applied to the second and fourth focusing electrode 32, 34. Thus, the potential difference of about 800 V occurs between each focusing electrode to form circular or quadrapole lenses in the prefocusing lens part. The electrostatic lens intensity T in the case where dynamic voltages DF1, DF2 are not being applied thereto, corresponds to Q+M and forms an equivalent circular lens, as the main lens intensity M lies over the diagonal circular optical line, and the quadrapole lens intensity Q of the prefocusing lens part lies under the diagonal circular optical line. In other words, the quadrapole lens formed in the prefocusing lens part has a negative aberration in which the horizontal beam is more intensively focused relative to the vertical beam, and the main lens formed at the main lens part 40 has a positive aberration in which the vertical beam is more intensively focused than the horizontal beam, thus the two lenses compensate for each other to cause the electron beams landing at the central portion of the screen to be circular.

And when dynamic voltages DF2, DF1 synchronized with the deflection signal are applied to the focusing voltage F2 of the first, third, and fifth electrode 31, 33, 35, and the focusing voltage F1 of the second and fourth electrode 32, 34, potential differences of 1,000 V or 1,200 V occur between each of the focusing electrodes. Thus, the circular or quadrapole lens of the prefocusing lens part 30 is relatively enhanced, and the main lens of the main lens part 40 is relatively weakened. As the result, the main lens intensity M is shifted toward the origin by $\Delta M$ to be weakened as described in FIG. 9, and the quadrapole lens intensity Q recedes from the origin by $\Delta Q$ to be enhanced, thus the overall lens intensity T becomes to $T+\Delta Q+\Delta M$ to form an asymmetrical lens when dynamic voltages DF1, DF2 are applied. In other words, the quadrapole lens intensity of the prefocusing lens part is enhanced, and the main lens intensity is weakened, thus the horizontal beam is just-focused in a optimal state and the vertical beam is under-focused at the central portion of the screen.

When the electron beam scans the peripheral portion of the screen by the non-uniform magnetic field of the deflection yoke, the vertical beam is overfocused and horizontal beam is just-focused to form a circular beam spot also at the peripheral portion of the screen.

As described above, in the electron gun for a color picture tube according to the present invention, the main lens has a positive aberration and the prefocusing lens has a negative aberration, to focus and accelerate the electron beam in multistage.

Thus, the focusing characteristics are improved to provide a uniform beam section all over the screen, and accordingly a high definition tube can be obtained.

We claim:

1. An electron gun for a color picture tube having a triple electrode, a prefocusing lens formed by a set of at least one round lens and at least one quadruple lens for preliminarily focusing and accelerating the electron beam emitted from said triple electrode, and a main lens for fmally focusing and accelerating the electron beam passed through said prefocusing lens, characterized in that:

said prefocusing lens comprises a first to fifth focusing electrode arranged successively from said triple electrode at least two different dynamically changing focus voltages being applied respectively to the said first, third and fifth focusing electrodes in common and to the said second and fourth electrodes in common, said focusing lens always having negative astigmatism; and, said main lens having positive astigmatism.

2. The electron gun of claim 1, wherein among said two different dynamically changed voltages synchronized with the deflection signal, the higher of said two dynamic voltages corresponds to twice the lower dynamic voltage.

3. The electron gun of claim 1, wherein said negative astigmatism in the said prefocusing lens results in stronger focus in the horizontal direction than in vertical direction.

4. The electron gun of claim 1, wherein said positive astigmatism in the said main lens results in stronger focus in the vertical direction than in the horizontal direction.

* * * * *